US007715281B2

(12) United States Patent
Goeller

(10) Patent No.: US 7,715,281 B2
(45) Date of Patent: May 11, 2010

(54) ALARM WATCH AND MECHANISM FOR DISPLAYING THE ALARM TIME

(75) Inventor: Eric Goeller, Les Hopitaux Vieux (CH)

(73) Assignee: Montres Breguet S.A., L'Abbaye (CH)

( * ) Notice: Subject to any disclaimer, the term of this patent is extended or adjusted under 35 U.S.C. 154(b) by 7 days.

(21) Appl. No.: 11/937,861

(22) Filed: Nov. 9, 2007

(65) Prior Publication Data

US 2008/0112272 A1 May 15, 2008

(30) Foreign Application Priority Data

Nov. 9, 2006 (EP) ..... 06123787

(51) Int. Cl.
*G04B 23/02* (2006.01)

(52) U.S. Cl. ..... 368/72; 368/244; 368/249

(58) Field of Classification Search ..... 368/72, 368/71, 73–75, 249, 243–244
See application file for complete search history.

(56) References Cited

U.S. PATENT DOCUMENTS

| | | | | |
|---|---|---|---|---|
| 1,327,669 | A * | 1/1920 | Gage | 368/72 |
| 2,712,215 | A * | 7/1955 | Kukol | 368/266 |
| 3,390,518 | A | 7/1968 | Negri | |
| 4,005,570 | A * | 2/1977 | Miyamoto et al. | 368/72 |
| 4,035,617 | A * | 7/1977 | Banner | 235/88 N |
| 5,042,016 | A * | 8/1991 | Suzuki et al. | 368/74 |
| 5,113,381 | A * | 5/1992 | Sakamoto et al. | 368/74 |
| 2004/0081026 | A1 * | 4/2004 | Krishnamani | 368/28 |
| 2004/0081027 | A1 * | 4/2004 | Gilomen | 368/76 |

FOREIGN PATENT DOCUMENTS

| | | |
|---|---|---|
| CH | 261676 | 9/1949 |
| CH | 510 906 | 3/1971 |
| DE | 247939 | 6/1912 |
| GB | 220335 | 2/1925 |
| GB | 1 397 982 | 6/1975 |

OTHER PUBLICATIONS

European Search Report issued in corresponding application No. EP 06 12 3787, completed Aug. 2, 2007.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

The alarm watch includes a mechanical movement, which drives a time display mechanism including at least a first hour hand (17) and a first minute hand (13) mounted above a first dial. The alarm watch also includes an alarm mechanism able to release an alarm at a predetermined alarm time, manually determined every twenty-four hours, and a mechanism for displaying the predetermined alarm time. The alarm time display mechanism includes at least a second hour hand (33) provided for displaying the alarm time in twelve hours, and an indicator (52) with two positions provided for specifying whether the alarm time is situated between midnight and midday (AM) or situated between midday and midnight (PM).

7 Claims, 4 Drawing Sheets

ALARM WATCH AND MECHANISM FOR DISPLAYING THE ALARM TIME

This application claims priority from European Patent Application No. 06123787.1, filed Nov. 9, 2006, the entire disclosure of which is incorporated herein by reference.

FIELD OF THE INVENTION

The present invention concerns mechanical alarm watches, which include a mechanism for displaying the alarm time over twenty-four hours. The present invention more specifically concerns such alarm time display mechanisms.

BACKGROUND OF THE INVENTION

Watches fitted with an alarm function and including an alarm time indication mechanism are known. Most of these timepieces include a striking work that is released every twelve hours and whose strike time is indicated by an additional hand. The alarm time may be set by moving the additional hand around the dial using the time-setting stem. One drawback of such timepieces is that it is not possible to set the alarm time more than twelve hours in advance.

GB Patent No. 1397982 discloses a timekeeper with an alarm that can be set twenty-four hours in advance. The dial of this timepiece includes an additional scale that divides the circumference of the dial into twenty-four hours. An alarm hand cooperates with this scale to indicate the selected alarm time. It is thus possible to select the striking time up to twenty-four hours in advance. This prior solution also has drawbacks. The division of the dial into twenty-four hours instead of twelve is unusual and can cause confusion. In such conditions, manipulation errors caused by incorrect reading of the alarm time are possible. Moreover, the fact of indicating the alarm time with a single hand associated with a dial including a large number of divisions means that the alarm time cannot be set with precision.

CH Patent No. 510906 discloses an alarm indicating and releasing device for a timepiece using a twelve-hour dial but that is only released every twenty-four hours. This feature is obtained owing to a cam moving intermittently every twelve hours to activate and deactivate the striking work once every two times. A coloured mark visible through the dial indicates whether the striking work will be released during the next twelve hours or the following twelve hours. The solution proposed by this prior document overcomes some of the aforementioned problems. However, the meaning of the coloured mark is not obvious to a new user. It is doubtful that someone would be able to understand the alarm time setting principle without using the instructions.

It is an object of the present invention to provide an alarm watch including an alarm time indication device that can be set up to twenty-four hours in advance and which is as easy to read as possible.

It is another object of the present invention to provide an alarm watch wherein the alarm time can be set with a high level of precision.

SUMMARY OF THE INVENTION

The present invention therefore provides an alarm watch in accordance with a first embodiment, wherein an alarm watch is provided that includes a mechanical movement driving time display means that includes at least a first hour hand and a first minute hand mounted above a first dial, an alarm mechanism able to release an alarm at a predetermined alarm time, manually determined every twenty-four hours, and means for displaying the predetermined alarm time, wherein the alarm watch is such that the alarm time display means include at least a second hour hand provided for displaying the alarm time in twelve hours, and an indicator with two positions provided for specifying whether the alarm time is comprised between midnight and midday or comprised between midday and midnight.

In accordance with a second embodiment of the invention, the alarm watch according to the first embodiment is further modified so that the alarm time display means include a second minute hand. In accordance with a third embodiment of the invention, the second embodiment is further modified so that the second hour hand is mounted above a second dial. In accordance with a fourth embodiment of the invention, the first, second or third embodiments are further modified so that the alarm mechanism includes a release wheel, one complete revolution of the release wheel corresponding to the travel of a twenty-four hour cycle by the alarm time, and wherein the second hour hand is kinematically connected to the release wheel such that one revolution of the wheel corresponds to two revolutions of the second hour hand. In accordance with a fifth embodiment of the present invention, the fourth embodiment is further modified so that the alarm watch includes an AM/PM cam secured to the release wheel and a lever provided for cooperating with the AM/PM cam, wherein the cam includes two halves having semicircular profiles of different diameters, and the cam is angularly fitted to the release wheel such that the "12 hour" position of the second hand coincides with the encounter of the lever with one or other of two transition flanks formed by the junction of the halves.

One advantage of the present invention is that the alarm time display means include a conventional twelve-hour display. This display can be read effortlessly, which limits the risk of errors when the alarm time is selected. Moreover, the fact of selecting the alarm time using a minute hand in addition to the hour hand provides more precise setting of the alarm time.

Another advantage of the present invention is that, unlike the distinction between the "next twelve hours" and the "following twelve hours" proposed in CH Patent No. 510906, the distinction between the morning time and the afternoon or evening time is a usual distinction that can be understood without any effort.

It will also be understood that the principle of indicating a time in twenty-four hours using a twelve hour display completed by an indication specifying whether the time is comprised between midnight and midday (AM) or comprised between midday and midnight (PM), is not, in itself, novel. However, these displays concern the current time and not the alarm time. Moreover, these AM/PM current time displays are generally deemed redundant since the wearer of a watch does not, in principle, need to use the latter to distinguish between night and day. Moreover, the fact of completing a twelve-hour current time display with an AM/PM indicator mechanism necessarily leads to an increase in the energy necessary for the watch to function. Given the foregoing, it will be evident that those skilled in the art may be unfavorably prejudiced against AM/PM displays.

Surprisingly, all of the defects that have just been mentioned concerning AM/PM displays disappear when this type of display is used for indicating an alarm time. To start with, in accordance with the above description, the possibility of being able to select a time in a twenty-four hour period constitutes an indisputable advantage when the time concerned is an alarm time. Moreover, the alarm time is a static indication, which only changes when the wearer of the watch selects a new alarm time. Thus the alarm time indication mechanism according to the invention is not driven by the watch movement. This mechanism does not, therefore, consume any mechanical energy.

According to an advantageous embodiment of the present invention, the watch in which the mechanism according to the invention is integrated includes at least two distinct dials. One of these dials is provided for displaying the alarm time and the other dial is provided for displaying the current time.

BRIEF DESCRIPTION OF THE DRAWINGS

Other features and advantages of the present invention will appear upon reading the following description, given solely by way of non-limiting example, with reference to the annexed drawings, in which.

DETAILED DESCRIPTION OF THE ILLUSTRATIVE EMBODIMENTS

Figure 1:
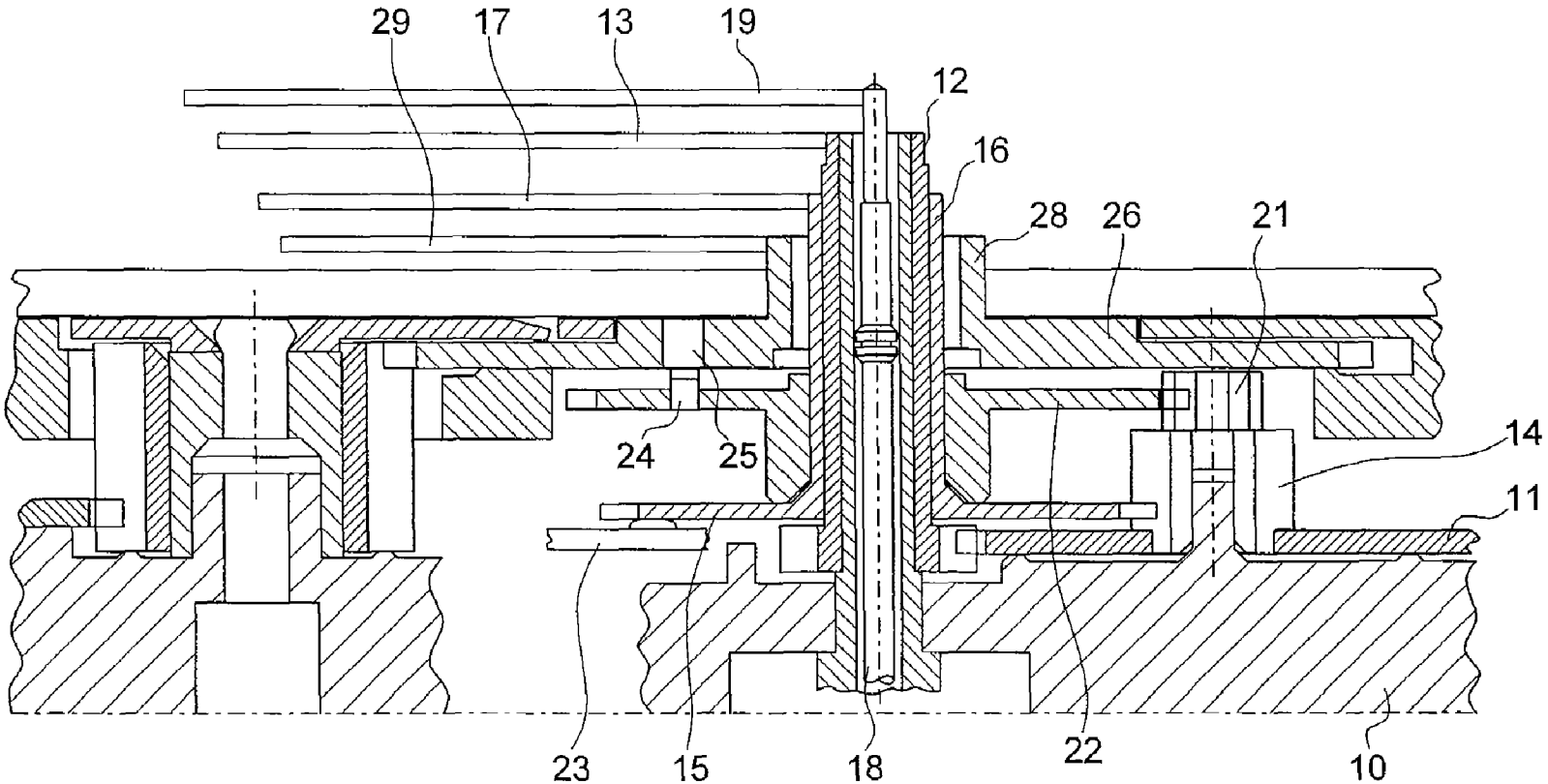
PRIOR ART Fig. 1
FIG. 1 is a partial cross-section of a gear train of an alarm watch of the prior art, and corresponds to FIG. 2 of GB Patent No. 1397982.

In order to facilitate comprehension of the following description, which specifically concerns the present invention, this description starts by presenting an alarm mechanism of the prior art, with reference to FIG. 1.

The movement shown in FIG. 1 includes a bottom plate 10 in which a minute wheel pipe 12, an hour wheel pipe 16 and a central arbour 18 pivot coaxially. These concentric arbours respectively carry the minute hand 13, the hour hand 17 and the second hand 19. These hands are provided for indicating the time in a usual manner on a twelve-hour dial (not shown). In order to do so, the hands are driven by the movement in a manner known to those skilled in the art. The partial view of FIG. 1 shows only the motion work, formed by the wheel 11 and the pinion 14 thereof, provided for kinematically connecting the minute pinion 12 to the hour wheel 15.

The watch further includes a striking mechanism, which is not shown, and a release mechanism. This mechanism includes a pinion 21, coaxially driven into motion work pinion 14, and meshing with a wheel 22 freely mounted on hour pipe 16. The gear ratios are calculated such that the movement drives wheel 22 through one revolution in twenty-four hours. It can also be seen in FIG. 1 that wheel 22 is supported by the hour wheel 15. A striking work release trigger 23, wound by a spring that is not shown, abuts against the bottom face of the hour wheel so as to push the latter, and wheel 22, upwards.

The plate of the "24 hour" wheel 22 includes three lugs 24 arranged at an unequal distance from the centre of the wheel and angularly shifted in relation to each other. The release mechanism further includes a release wheel 26 friction mounted in the arbour of the hands and thus coaxial with wheel 22. The pipe of wheel 26 carries an alarm time hand 29. This hand is provided for cooperating with additional indications (not shown) defining a twenty-four hour hour-circle around the dial.

In a known manner, the alarm watch further includes a winding and time-setting stem (not shown) for setting the time and moving alarm time hand 29. The switch between the time-setting function and the alarm hand movement function can for example be achieved using a push-button (not shown), the function of which is to mesh release wheel 26 with an intermediate wheel, itself driven by the sliding pinion (not shown). This type of mechanism is disclosed, in particular, in CH Patent No. 261676. Owing to this mechanism, the wearer of the watch can move the release wheel 26 in rotation by rotating the winding and time-setting stem. Thus, he can move alarm time hand 29 into a position corresponding to the desired alarm time.

The release mechanism of FIG. 1 operates as follows. The plate of release wheel 26 is pierced with three apertures 25 for cooperating with the three lugs of the "24 hour" wheel 22. The striking work release trigger 23 permanently presses wheel 22 against release wheel 26. When they rotate, at the time set for the alarm, the three lugs 24 of wheel 22 move opposite apertures 25. In this configuration, which only occurs once every twenty-four hours, the lugs can enter apertures 25, which allows wheel 22 to be pressed against release wheel 26. Pushed by release trigger 23, hour wheel 15 accompanies wheel 22 in the elevational movement thereof, which allows the striking work release mechanism to tip and release the striking work.

Figure 2:
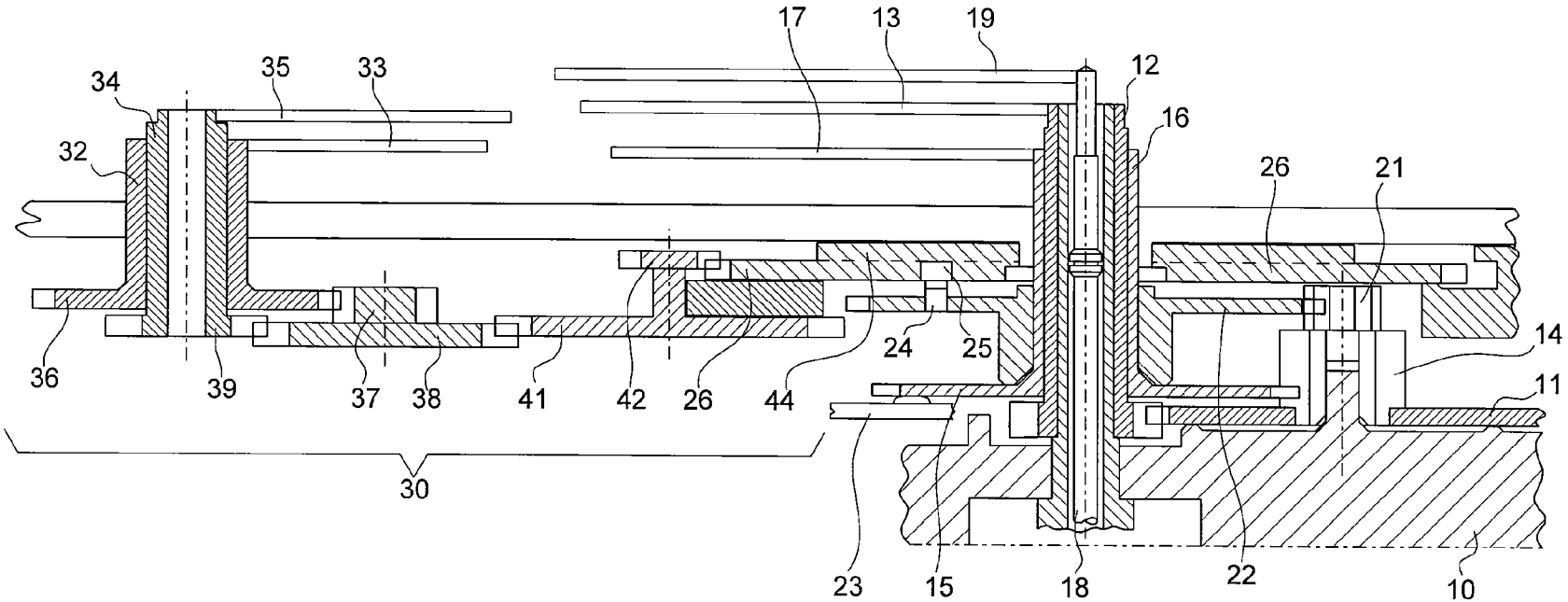
FIG. 2 is a partial cross-section of the gear train of an alarm watch according to a particular embodiment of the present invention.

FIG. 2 is a partial cross-section of a first embodiment of the present invention. In this first embodiment, the current time display mechanism and the striking work release mechanism are identical to those described with reference to FIG. 1. This is why the part of FIG. 2 that concerns these mechanisms is taken from FIG. 1. In particular, the elements referenced 10 to 26 are shown in both Figures with the same reference numerals. The function of these elements will not therefore be described a second time.

Figure 4:
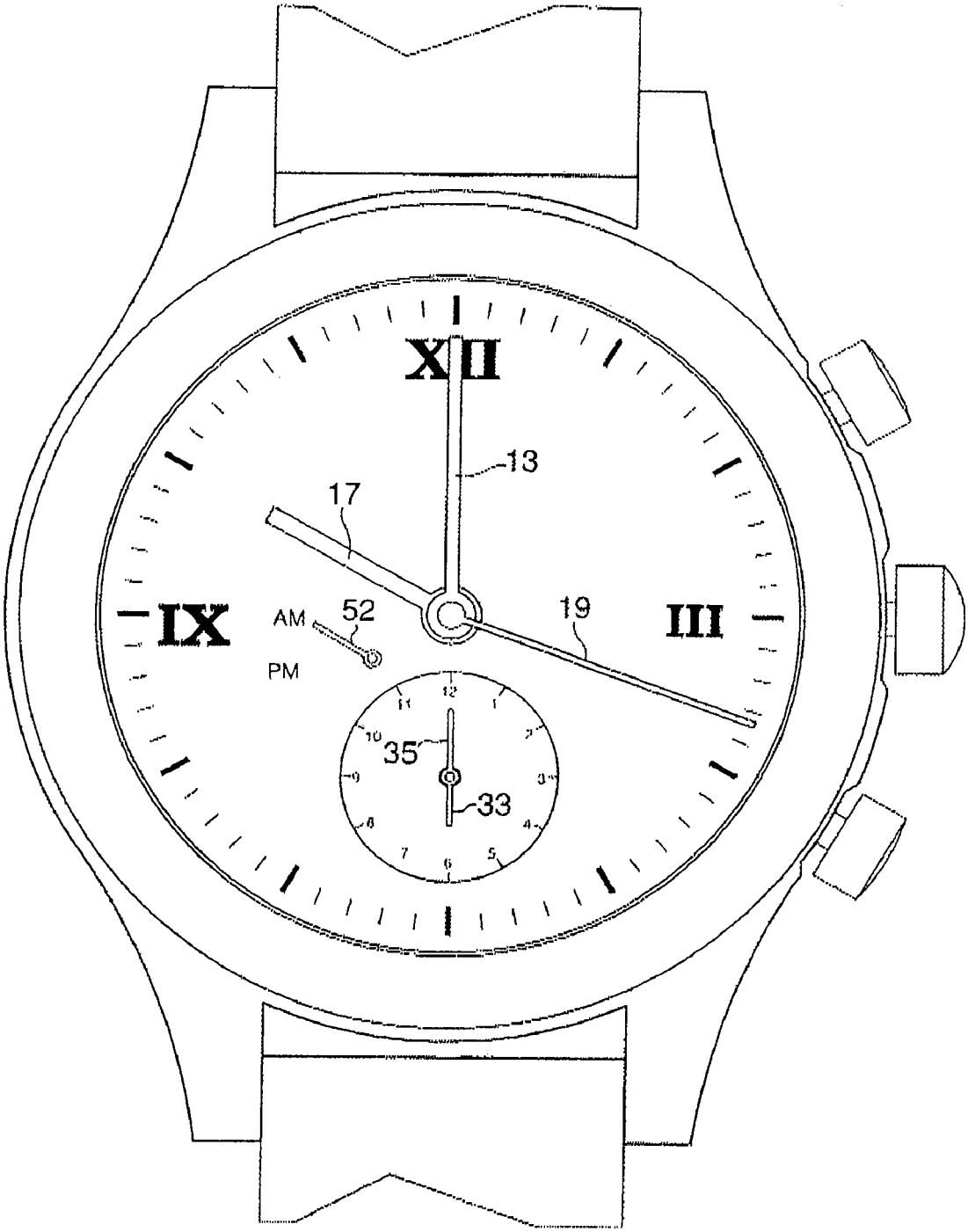
FIG. 4 is a plan view of an alarm watch according to the particular embodiment of the invention illustrated in FIG. 2.

We have seen that, in the alarm watch shown in FIG. 1, the pipe of release wheel 26 carries an alarm time hand 29 provided for cooperating with a twenty-four hour hour-circle. In the example shown in FIG. 2, the alarm time hand 29 is replaced by an alarm time display mechanism according to the present invention. This mechanism (generally referenced 30) includes a second hour wheel pipe 32 and a second minute wheel pipe 34 provided for pivoting coaxially about an axis that is off-centre relative to the dial, above which the hands 13, 17 and 19 rotate. Pipes 32 and 34 respectively carry an hour hand 33 and a minute hand 35 provided for indicating the alarm time on a second twelve-hour dial (shown in FIG. 4).

In a known manner, hour hand 33 and minute hand 35 are kinematically connected by a motion work such that the minute hand completes exactly 12 revolutions for one revolution of the hour hand. FIG. 2 shows that the motion work includes a wheel 38 and the associated pinion 37, which mesh respectively with the minute pinion 39 and the hour wheel pipe 36. FIG. 2 also shows that a wheel set formed of a wheel 41 and the associated pinion 42 connect release wheel 26 to motion work wheel 38. Hands 33 and 35 are thus kinematically connected to release wheel 26. The gear ratios are calculated such that hour hand 33 completes exactly two revolutions for each revolution of release wheel 26. Thus when the wearer of the watch rotates the release wheel by activating the winding and time setting stem (not labelled in FIG. 4), he also rotates hands 33 and 35. By changing the pre-selection of the time at which the striking work will be released or triggered, the wearer of the watch thus also alters the alarm time displayed by the hands. This feature thus prevents any risk of any discrepancy between the alarm time indicated and the real striking work release time. However, it is important to mention that the gearing that has just been described must be properly set such that release wheel 26 and hands 33 and 35 coincide.

Figure 3:
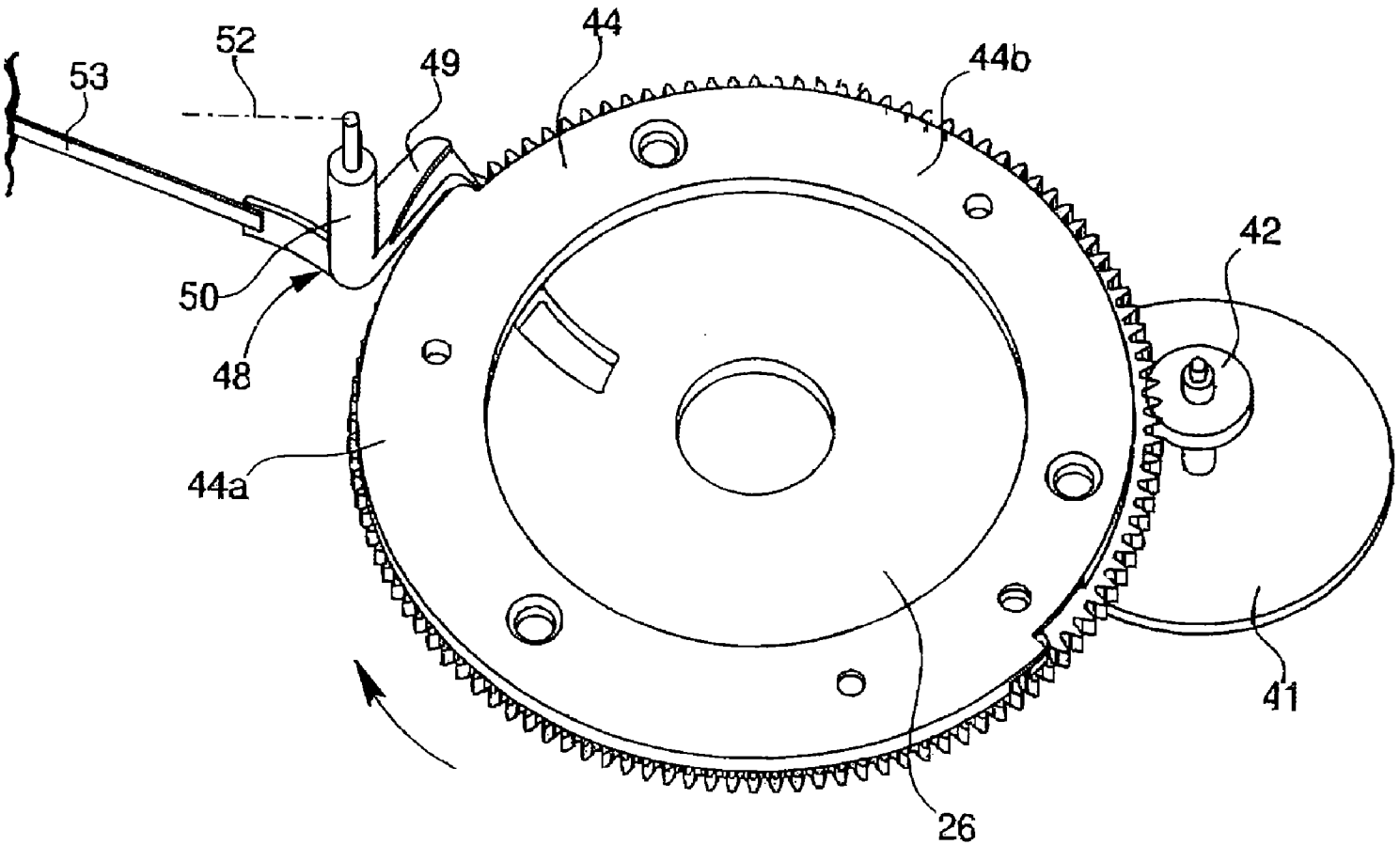
FIG. 3 is a perspective elevation view showing the release wheel and the AM/PM mechanism of the alarm watch of FIG. 2.

FIG. 3 is a perspective top view showing release wheel 26 and pinion 42 and wheel 41 which connect the latter to alarm time display hands 33 and 35. Wheel 26 also carries a cam, hereinafter called the AM/PM cam and referenced 44. As can be seen in the Figure, the AM/PM cam is formed by the juxtaposition of two halves having semicircular profiles of different radiuses. At the join between the two halves, referenced 44*a* and 44*b*, the cam profile also has two transition flanks 45, 46. A lever 48 is provided for cooperating with cam 44. As can be seen, this lever is formed of a horizontal arm 49 and a vertical pivot 50. The top end of pivot 50 emerges from the dial (as evident from FIG. 4) and carries an AM/PM hand 52. FIG. 3 also shows a spring 53 provided for returning lever 48 to the control surface of cam 44.

AM/PM cam 44 is secured to release wheel 26, such that one complete revolution of the cam corresponds to two revolutions completed by hour hand 33. In such conditions, since the two transition flanks 45 and 46 are separated from each other by a half-revolution, lever 48 encounters one of the two transition flanks 45 and 46 exactly once per revolution of hour hand 33. Cam 44 can thus be angularly fitted to release wheel 26 such that lever 48's encounter with one or other of the two transition flanks always coincides with the superposition of hour hand 33 and minute hand 35 at twelve o'clock. The AM/PM hand 55 carried by lever 48 is provided for indicating whether the alarm time displayed by hands 33 and 35 is situated between midnight and midday (AM) or between midday and midnight (PM). It will therefore be clear that AM/PM hand 52 switches from one indication to the other each time that lever 48 encounters one of transition flanks 45 or 46.

Let us recall that the twenty-four hour alarm time display mechanism in AM/PM mode that has just been described, is a static display which is not driven by the watch movement. In such conditions, the presence thereof has no influence on the power reserve.

As has been seen, in the embodiment that has just been described, the release mechanism is a mechanism that has already been disclosed as such in the prior art document GB 1397982. However, it will be understood that various alterations and/or improvements evident to those skilled in the art could be made to the embodiment that forms the subject of this description without departing from the scope of the present invention defined by the annexed claims. In particular cooperation between "24 hour" wheel 22 and release wheel 26 must not necessarily be obtained by pressing these two wheels axially one against the other. The ordinarily skilled person in the art will understand that the two wheels could also cooperate, for example, through a cam type mechanism. In this case the circumference of one of the wheel would carry a notch, while the other wheel would carry some kind of cam follower.

What is claimed is:

1. An alarm watch including:

(a) a mechanical movement driving time display means including at least a first hour hand and a first minute hand mounted above a first dial;

(b) an alarm mechanism able to release an alarm at a predetermined alarm time, manually determined every twenty-four hours; and (c) means for displaying the predetermined alarm time, wherein the alarm time display means includes at least a second hour hand provided for cooperating with a twelve-hour dial for displaying the alarm time in twelve hours, and a mobile indicator that is arranged to occupy a first one of two positions when the alarm time is situated between midnight and midday, and that arranges to occupy a second one of the two positions when the alarm time is situated between midday and midnight, wherein the alarm mechanism includes a release wheel, wherein one complete revolution of the release wheel corresponds to travel of a twenty-four hour cycle by the alarm time, and wherein the second hour hand is kinematically connected to the release wheel so that one revolution of the release wheel corresponds to two revolutions of the second hour hand, and the alarm watch further includes (d) an AM/PM cam secured to the release wheel and a lever provided for cooperating with the AM/PM cam, the cam including two halves having semicircular profiles of different diameters, and the cam is angularly fitted to the release wheel so that the "12 hour" position of the second hand coincides with an encounter of the lever with one or other of two transition flanks formed by a junction of the halves.

2. The alarm watch according to claim 1, wherein the alarm time display means includes a second minute hand.

3. The alarm watch according to claim 1, wherein the lever comprises a horizontal arm and a vertical pivot, wherein the vertical pivot is disposed so that a top end of the vertical pivot emerges from the first dial and carries the mobile indicator.

4. The alarm watch according to claim 3, wherein the mobile indicator is an AM/PM hand.

5. The alarm watch according to claim 3, wherein the horizontal arm of the lever is disposed to engage a control surface of the AM/PM cam.

6. The alarm watch according to claim 5, further comprising a spring disposed to return the horizontal arm to the control surface of the AM/PM cam.

7. The alarm watch according to claim 1, wherein the mobile indicator is moveable only between the first one of the two positions and the second one of the two positions.

* * * * *